US005910048A

United States Patent [19]

Feinberg

[11] Patent Number: 5,910,048

[45] Date of Patent: Jun. 8, 1999

[54] LOSS LIMIT METHOD FOR SLOT MACHINES

[76] Inventor: Isadore Feinberg, 1717 St. Georges Rd., Dresher, Pa. 19025

[21] Appl. No.: 08/758,439

[22] Filed: Nov. 29, 1996

[51] Int. Cl.[6] ..... A63F 9/24

[52] U.S. Cl. ..... 463/25; 463/16; 463/20

[58] Field of Search ..... 463/25, 20, 16, 463/21, 29

[56] References Cited

U.S. PATENT DOCUMENTS

| | | | |
|---|---|---|---|
| 4,198,052 | 4/1980 | Gauselmann | 273/143 R |
| 4,636,951 | 1/1987 | Harlick | 463/25 |
| 4,657,256 | 4/1987 | Okada | 463/21 |
| 4,715,604 | 12/1987 | Okada | 273/143 R |
| 4,880,237 | 11/1989 | Kishishita | 463/25 |
| 5,083,785 | 1/1992 | Okada | 463/21 |
| 5,393,061 | 2/1995 | Manship et al. | 463/20 |
| 5,457,306 | 10/1995 | Lucero | 463/25 |
| 5,551,692 | 9/1996 | Pettit et al. | 463/25 |
| 5,559,312 | 9/1996 | Lucero | 463/25 |
| 5,655,961 | 8/1997 | Acres et al. | 463/25 |
| 5,766,075 | 6/1998 | Cook et al. | 463/25 |

*Primary Examiner*—Jessica J. Harrison
*Assistant Examiner*—James Schaaf
*Attorney, Agent, or Firm*—Panitch Schwarze Jacobs & Nadel, P.C.

[57] ABSTRACT

A method of operating slot machines to limit a player's losses is provided. The method comprises the steps of identifying a player; tracking an amount played and an amount paid out to the player by a first slot machine; determining if the player has lost more than a predetermined loss amount; and if the player has lost more than the predetermined loss amount after one of a predetermined number of plays, a predetermined amount played, a predetermined time of play, and the player stopping further play, crediting the player the difference between the predetermined loss amount and the player's actual loss.

10 Claims, 2 Drawing Sheets

LOSS LIMIT METHOD FOR SLOT MACHINES

BACKGROUND OF THE INVENTION

The present invention relates to gaming machines, and more particularly, to a method of limiting a player's losses to increase player usage.

Gaming machines or slot machines are generally known in the art. However, due to low expected player win percentages, slot machines are underutilized since players for the most part feel that the slot machines result in quick losses and provide too short a period of play prior to the player losing their stake. During the last year, the largest 19 Las Vegas area casinos averaged a daily win of about $81.77 per slot machine for 25¢ slot machines, and the average statewide for Nevada was $65.89 per day. It would be desirable to increase player utilization of slot machines in order increase casino earnings while at the same time providing players with more incentives to play slot machines.

One known slot machine design includes a special win cycle to ensure that a player wins at least one game in each of a predetermined number of games. This keeps the player interested in the game if a win occurs prior to the player losing interest. However, nothing ensures that the amount the player wins is high enough for the player to feel that the entertainment value for the time and money spent would encourage repeat usage.

In another known gaming machine, pay-out tables are selected so that the expected return of the machine is 80%, and the hit ratio of the machine is around 40% to 50%. This is accomplished by using payout tables which can pay-out less than what was wagered in a given play, with the possibility of receiving pay-outs from more than on pay table in a given play. This provides a high number of win opportunities, but a certain number of players will still lose their stake more quickly than the average over a long period of time, resulting in those players not being repeat slot machine users.

It would also be desirable for casinos to encourage more people to play during lower usage time periods to at least generate some income from the slot machines.

BRIEF SUMMARY OF THE INVENTION

Briefly stated, the present invention provides a method of operating slot machines to limit a player's losses. The method comprises the steps of:

(a) identifying a player;

(b) tracking an amount played and an amount paid out to the player by a first slot machine;

(c) determining if the player has lost more than a predetermined loss amount; and (d) if the player has lost more than the predetermined loss amount after one of a predetermined number of plays, a predetermined amount played, a predetermined time of play, and the player stopping further play, crediting the player the difference between the predetermined loss amount and the player's actual loss.

In another aspect, the present invention provides a method of operating slot machines to limit a player's losses. The method comprises the steps of:

(a) identifying a player;

(b) tracking a period of play, an amount played and an amount paid out to the player by a first slot machine;

(c) determining if the player has lost more than a predetermined amount for the period of play; and (d) if the player has lost more than the predetermined amount for the period of play, increasing the slot machine pay out to the player.

BRIEF DESCRIPTION OF THE SEVERAL VIEWS OF THE DRAWINGS

The foregoing summary, as well as the following detailed description of preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
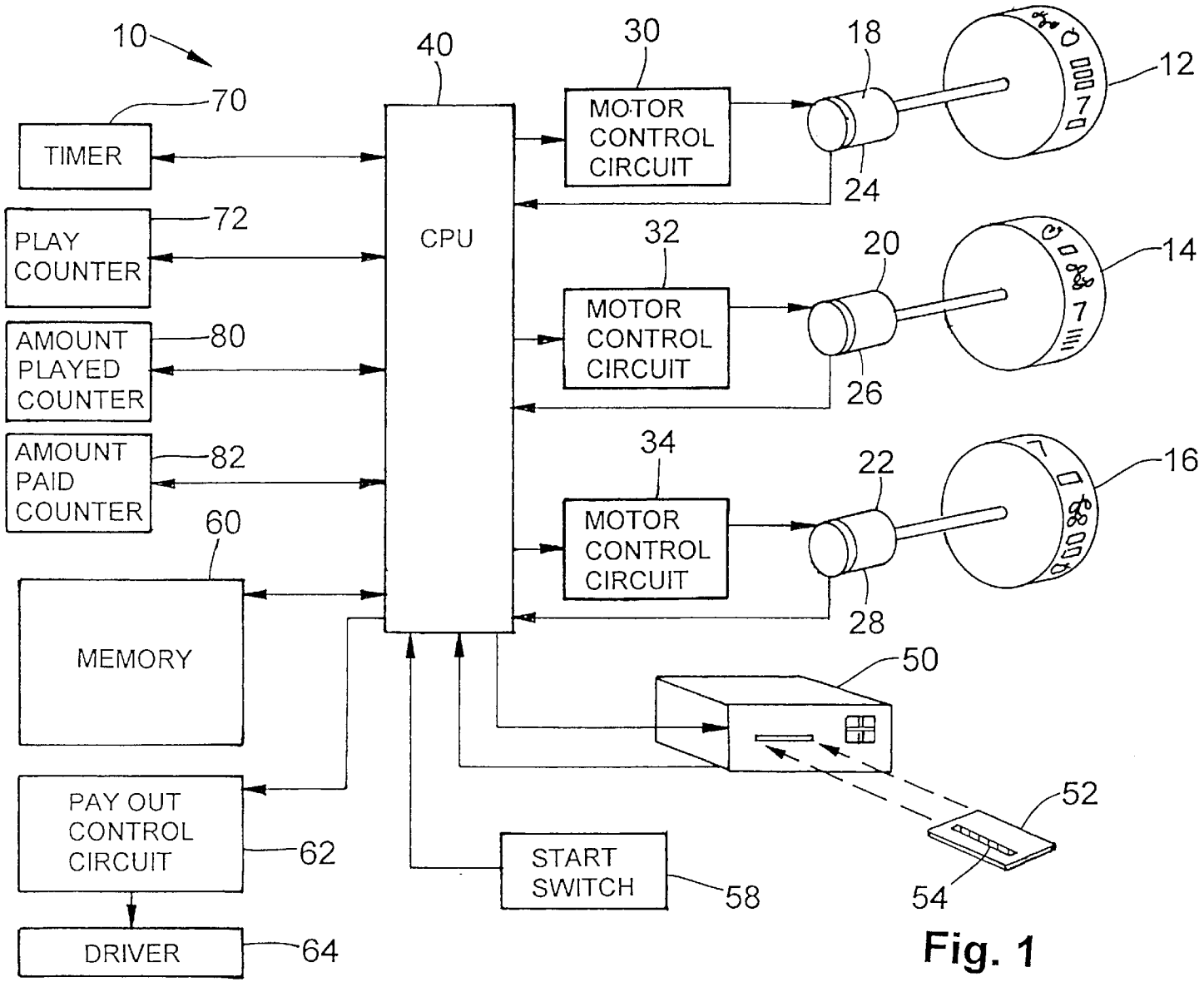
FIG. 1 is a block diagram showing the components of a game in accordance with the present invention.

Certain terminology is used in the following description for convenience only and is not limiting. The words "right," "left," "lower" and "upper" designate directions in the drawings to which reference is made. The terminology includes the words above specifically mentioned, derivatives thereof and words of similar import.

In FIG. 1, there is shown a schematic view of a gaming machine or slot machine 10 in accordance with the present invention. The gaming or slot machine 10 is represented as having reels 12, 14, 16, with each reel 12, 14, 16 including various symbols, such as bars, double bars, triple bars, sevens, lemons, etc. The symbols can be observed by a player of the slot machine 10 in use. When the symbols upon each of the reels 12, 14, 16 are properly aligned on a win line, which is visually ascertainable to a player using the machine 10, a "winning event" occurs which returns a payoff to the player. While the embodiment of FIG. 1 is illustrated as including reels 12, 14, 16, it will be understood by the skilled artisan that the symbols could be generated on an electronic display, such as a cathode ray tube or an LCD screen. Additionally, multiple winning events can occur on a single play by providing more than one win line.

In the preferred embodiment shown in FIG. 1, the reels 12, 14, 16 are preferably driven by motors 18, 20, 22. Photo sensors or rotary encoders 24, 26, 28 are provided for each respective motor 18, 20, 22. Motor control circuits 30, 32, 34 are in communication with each respective motor/photo sensor combination 18, 24; 20, 26; and 22, 28 in order to control the rotation and track the position of the reels 12, 14, 16. The motor control circuits 30, 32, 34 are in communication with a central processing unit (CPU) 40.

The slot machine 10 further includes a card reader/encoder 50 which is in communication with the CPU 40 of the slot machine 10. The card reader/encoder 50 is adapted to receive a card 52 having encoded information, read the encoded information from the card 52, and encode new information on the card 52. Preferably, the card reader/encoder 50 is a magnetic card reader and reads encoded information from the card 52, which includes a magnetic stripe 54 upon which information is encoded. Additionally, printed information can be recorded on the face of the card 52 by the reader/encoder 50, if desired. The information from the card 52 is read by the reader/encoder 50 and transmitted to the CPU. Updated information can also be transmitted from the CPU to the reader/encoder 50 and recorded on the card 52.

A start switch 58 is located on the slot machine 10 and is used to initiate play by signaling the CPU 40, which in turn signals the motor control circuits 30, 32, 34 to rotate the reels 12, 14, 16. After a predetermined time period, the reels 12, 14, 16 are stopped. The position of the symbols on the reels 12, 14, 16 which stop along the win line are then determined by the CPU 40. This can be accomplished by counting the number of drive pulses supplied to each reel 12, 14, 16 if the motors used are stepper motors, or can be read directly by the rotary encoders 24, 26, 28 which track the position of the reels 12, 14, 16.

The CPU 40 judges whether the combination of symbols which stop on one or more win lines corresponds to a winning combination. If the combination is a winner, a pay out table is read from the memory 60 by the CPU 40, and the CPU 40 determines the amount to be paid for the winning combination. The CPU 40 then signals a payout control circuit 62 to pay the winning amount. The payout control circuit 62 is in communication with a driver 64 which causes the slot machine 10 to pay out the win amount. The win amount can be paid in coins which are dropped into a player accessible hopper on the machine 10, or can be electronically tracked by the CPU 40 and credited to the player.

Preferably, a timer 70 is provided in communication with the CPU 40. The timer 70 tracks the amount of time that a player, identified by a card 52 inserted into the card reader/encoder 50, utilizes the slot machine 10. However, it will be recognized by those skilled in the art from the present disclosure, that the timer 70 may be omitted, if desired.

A play counter 72 is also preferably provided in communication with the CPU 40. The play counter 72 counts the number of plays for a given player, identified by a magnetic card 52 inserted by a player into the card reader/encoder 50. However, it will be similarly recognized by those skilled in the art that the play counter may be omitted, if desired.

An amount play counter 80 is provided in communication with the CPU 40 and tracks the amount of money paid into the slot machine 10 by a player, based on the player identity on a given magnetic card 52, and a similar counter 82 tracks the amount paid to the identified player. The amount played and amount paid counters 80, 82 can track coins or electronic wagers wherein an amount of credit is played in the slot machine memory either by the magnetic card 52, or by a separate transaction to provide credit which is tracked by the CPU 40 in the slot machine 10. One such system for providing credit to a slot machine player is described in U.S. Pat. No. 5,457,306, which is incorporated herein by reference as if fully set forth.

Figure 2:
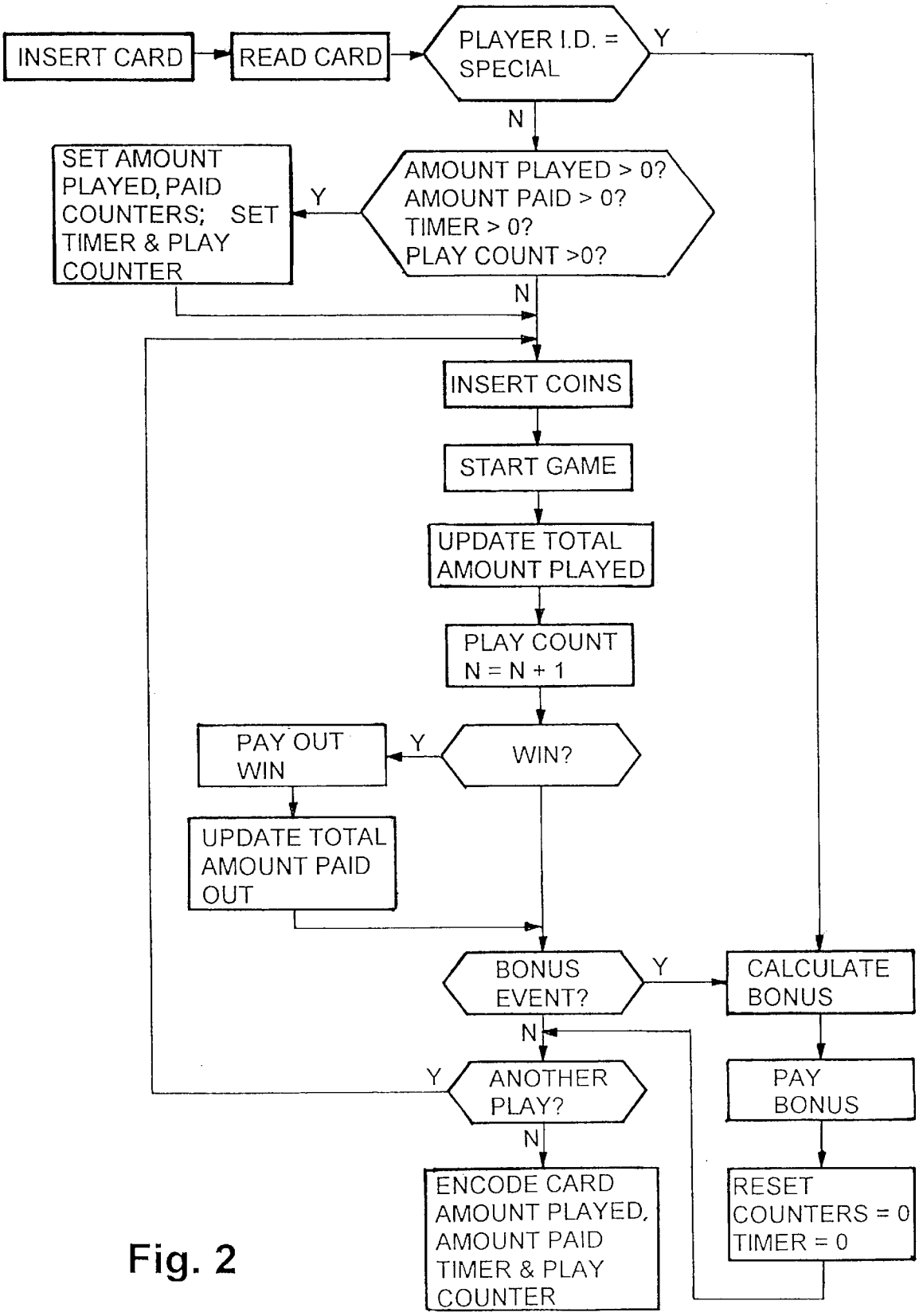
FIG. 2 is a flow chart of the events of a game played in accordance with a preferred embodiment of the present invention.

Referring now to FIG. 2, the slot machine 10 in accordance with the present invention is operated to limit a player's losses and can be used to provide a true fixed win percentage for each player. The player inserts his card 52 into the slot machine 10 and the magnetic stripe 54 on the card 52 is read by the card read/encoder 50. The card 52 preferably includes data on the player identity such that the player, or the player's card 52 is differentiated from other cards, and is recognized by the slot machine 10. Cards 52 can be provided to players as special promotional items by mailing or may be obtained directly at casino from a centralized area. The card 52 can also include credit or account data, such as a prepaid card which can be used in certain types of slot machines to avoid the need to insert coins, if desired. Additionally, the player identity can be encoded to include special win or bonus payments to a player for promotional purposes.

The card 52 also includes encoded data for the amount previously played and amounts previously paid out to the player, as well as data on the time played and the number of plays previously made by the player. The card reader/encoder 50 reads the card 52 and if the amount played is greater than zero, the amount paid is greater than zero, the time is greater than zero and/or the play count is greater than zero, the timer 70, play counter 72, amount played counter 80 and amount paid counter 82 are updated with the data read from the card 52. The player then inserts coins or otherwise indicates the amount being played for a given play of the slot machine. The start switch 58 is then actuated to start turning the reels 12, 14, 16.

At this point in time, the total amount played by the player is updated by the CPU 40 and the play count is updated to indicate an additional play. The reels 12, 14, 16 are stopped and the CPU 40 determines whether the combination of symbols displayed on the one or more win lines corresponds to a winning combination. If a win occurs, the payout control circuit 62 is actuated and the driver 64 pays out coins to the player. Alternatively, the win can be credited to the player electronically depending upon the type of slot machine 10 being utilized. The amount paid out counter 82 is updated by the CPU 40 with any win amount.

At this point, if one of a number of triggering events occurs, a bonus or loss limit amount is calculated and paid to the player to limit the player's losses for one of a time period of play, a number of plays, or an amount played. The triggering event can be triggered by the timer 70, play counter 72, or amount played counter 80, reaching a certain predetermined level. The amount played by the player and the amount paid out to the player are compared by the CPU 40. If the amount paid out is not equal to or greater than a predetermined loss limit, which can be stored in the memory 60 or encoded on the card 52, a bonus or loss guarantee amount is paid to the player by the machine, either in coin or as an electronic credit. This type of payment ensures that no player losses more than a certain percentage without the necessity of entering the slot machine mechanism to adjust the win percentage or accounting for short term fluctuations in wins/loss percentages which can be expected with any slot machine, although the long term win/loss percentage can be set with some accuracy. Once a bonus has been paid, the counters are reset to zero. If the player desires another play, the process is repeated.

If no bonus event occurs and the player wishes to stop further play, the player's card 52 is encoded with data for at least the amount played and the amount paid out to the player currently in the counters 80 and 82, as well as the time played and the number of plays in counters 70 and 72, if desired. The encoded card 52 is then removed from the slot machine 10.

If desired, the player's card 52 can be turned in to a centralized area with a card reader/encoder where the player's card is read to determine if the player has lost more than the predetermined loss amount based on a total amount played. The difference between the predetermined loss amount and the player's actual loss is calculated based on the encoded data, and the player is credited for all or a portion of the excess losses above the loss limit. Those skilled in the art will recognize from the present disclosure that all bonuses or loss guarantee amounts can be paid from a centralized location based on the data encoded on the card 52, and that the slot machine 10 need not determine if any triggering events for a bonus occurs. This simplifies the circuitry and logic in the slot machine 10.

Guaranteed loss limits can be set at a single rate, such as 8%, or can be varied. For example, the loss limits can change as a function of total coins played over a given period as follows:

| Coins Played | Amount Played | Loss Limit | Adjusted Win Percentage |
|---|---|---|---|
| 1000 | $250 | $20 | 8.00% |
| 1500 | $375 | $28.13 | 7.50% |
| 2000 | $500 | $35.00 | 7.00% |
| 3000 | $750 | $45.00 | 6.00% |
| 4000 | $1000 | $55.00 | 5.50% |

This allows the effective slot machine win percentage to be adjusted to provide the player with a better expected win percentage for continued play, encouraging greater usage.

It is also within the scope of the present invention for the player to signal the slot machine 10 so that no further play is desired and for the slot machine 10 to calculate a final close out payoff to insure that the player has not lost more than predetermined lost amount based on the amount paid and the amount played in the machine 10, prior to the player's card 52 being returned to the player. In this case, if a close out feature is provided, the timer, play count, amount played and amount paid would be reset to zero prior to encoding the data on the player's card and returning the card 52 to the player.

If the player desires to continue playing on a second machine, the CPU 40 reads the data from the timer 70, the play counter 72, the amount played counter 80, and the amount paid out counter 82 from the first machine 10, and signals the card reader encoder 50 to encode the data for at least the amount played and the amount paid out to the player, and preferably also for the time played and the number of plays onto the encodable card 52. The encoded card 52 is removed from the first card reader/encoder 50 on the first slot machine 10 and inserted into a second card reader/encoder in communication with a second slot machine. The encoded data on the encodable card 52 from the first slot machine is read by card reader/encoder in the second slot machine, and the CPU updates the timer, play counter, amount played counter and amount paid counter in the second slot machine based on the encoded data on the encodable card 52 from the first slot machine 10.

When a triggering event occurs in the second slot machine, the CPU in the second slot machine determines if the player has lost more than the predetermined loss amount based on a total amount played in the first and second slot machines and a total amount paid out by the first and second slot machines. As noted above, the triggering event for a bonus or loss limit payment can be based on the time played, number of plays, or the amount played, or any other desired event.

If the player desires to discontinue play on the second slot machine, updated data for a total amount played in the first and second slot machines and the total amount paid out by the first and second slot machines is calculated by the CPU of the second slot machine. This updated data is then encoded on the encodable card 52 by the second card reader/encoder such that the total amount played and the total amount paid out to the player by the first and second slot machines is encoded on the card 52.

In order to encourage additional slot machine play during slow usage periods, such as the time period between 12:00 p.m. and 6:00 a.m., different usage schedules with different predetermined loss amounts are provided. The predetermined loss limits for the slow usage periods are set at lower amounts to encourage play. For example, if a slot machine has a predetermined win percentage of 8.5%, a player can generally expect a return of approximately 91.5% of all coins or amounts played. During a very slow period of slot machine utilization, such as between 12:00 p.m. and 6:00 a.m. on weekdays, utilization of the slot machines can be increased if the player win percentage is increased to 98% and the house take is lowered to 2%. This is accomplished by providing a usage schedule with a smaller loss limit such that the player is guaranteed a minimum return of 98% from the slot machine 10 during the low usage period. This provides the player with the opportunity to win jackpots, mega prizes and other prizes with a guaranteed maximum loss of only 2% during the slow usage period. This can be done without any change to the slot machine 10 if bonus or loss limit amounts are paid from a centralized location. Alternatively, the player win percentage for a given usage period can be encoded on the player's card 52 and read by the CPU 40 to determine bonus or loss limit pay out amounts.

Additionally, it is possible to provide preferred or frequent players an incentive to show appreciation. The win percentage for the player is set to an amount greater than 100% such that the casinos win percentage is negative. This means that over a period of time the slot machine 10 guarantees a payback to the player of greater than the amount wagered by the player.

For example, the casino sets a 103.5% return for a limited time period to a preferred player by setting a negative lost limit. The player plays 1,500 coins and has payoffs of 1,344 coins, the player has a net lost of 156 coins. However, during the special time period 103.5% of the 1,500 coins would be paid back to the player as a guaranteed minimum. Therefore, a bonus or loss limit payment of 209 coins would be paid to the player to ensure that the player obtained a guaranteed win of 3.5% of the coins played.

By using the method of the present invention, player loss limits can be guaranteed to encourage additional play or encourage a player to continue playing until a bonus or lost limiting event occurred. This can also be used to increased slot machine utilization during slow periods or to provide special promotional events whereby players are guaranteed to win more than the amount played.

Additionally, utilization schedules can be used to provide different loss limits for different usage periods to encourage more play during low usage periods by guarantying a higher player win percentage through the use of bonus or loss limiting payment as described above.

The present invention also provides casinos with the ability to vary the effective slot machine win percentages without physically entering the slot machine, with the ability to guarantee each player a precise win percentage.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method of operating slot machines to limit player's losses, comprising the steps of:

identifying a player;

tracking an amount played and an amount paid out to the player by a first slot machine;

determining if the player has lost more than a predetermined loss amount;

if the player has lost more than the predetermined loss amount after one of a predetermined number of plays, a predetermined time of play, and the player stopping further play, crediting the player the difference between the predetermined loss amount and the player's actual loss; and providing a usage schedule with different predetermined loss amounts associated with different slot machine usage periods, such that the predetermined loss amounts are lower during low slot machine usage periods.

2. The method of claim 1 further including the steps of:

inserting an encodable card into a card reader/encoder in communication with the slot machine, the encodable card being capable of accepting and storing encoded data for the player identity, the amount played and the amount paid out to the player;

encoding data on the encodable card for the amount played and the amount paid out to the player;

removing the encoded card from the slot machine; and calculating the difference between the predetermined loss amount and the player's actual loss based on the encoded data.

3. The method of claim 1 further including the steps of:

inserting an encodable card into a first card reader/encoder in communication with a first slot machine, the encodable card being capable of accepting and storing encoded data for the player identity, the amount played and the amount paid out to the player by the first slot machine;

encoding data on the encodable card for the amount played and the amount paid out to the player from the first slot machine;

removing the encoded card from the first card reader/encoder;

inserting the encoded encodable card into a second card reader/encoder in communication with a second slot machine;

reading the encoded data on the encodable card from the first slot machine;

determining if the player has lost more than the predetermined loss amount based on a total amount played in the first and second slot machines and a total amount paid out by the first and second slot machines.

4. The method of claim 3 further comprising the steps of:

calculating updated data for a total amount played in the first and second slot machines and a total amount paid by the first and second slot machines; and encoding updated data on the encodable card with the second card reader/encoder for a total amount played and a total amount of money paid out to the player by the first and second slot machines.

5. A method of operating slot machines to limit a player's losses, comprising the steps of:

identifying a player;

tracking a period of play, an amount played and an amount paid out to the player by a first slot machine;

determining if the player has lost more than a predetermined amount for the period of play; and if the player has lost more than the predetermined amount for the period of play, increasing the slot machine pay out to the player.

6. The method of claim 5 wherein the step of increasing the slot machine payout to the player comprises the step of paying a bonus payoff to the player of up to the difference between the predetermined loss amount and the player's actual loss.

7. The method of claim 5 wherein the step of increasing the slot machine payout to the player comprises the step of paying a bonus payoff to the player of greater than the difference between the predetermined loss amount and the player's actual loss.

8. The method of claim 5 wherein the step of increasing the slot machine payout to the player comprises the step of increasing the winning percentage for the slot machine.

9. The method of claim 5 further including the steps of:

inserting an encodable card into a first card reader/encoder in communication with the first slot machine, the encodable card being capable of accepting and storing encoded data for the player identity, the period of play, the amount played and the amount paid out to the player;

encoding data on the encodable card for the period of play, the amount played, and the amount paid out to the player from the first slot machine;

removing the encoded card from the first card reader/encoder;

inserting the encoded card into a second card reader/encoder in communication with a second slot machine;

reading the encoded data from the first slot machine on the encodable card with the second card reader/encoder;

determining if the player has lost more than the predetermined loss amount for the predetermined period of play based on a total period of play for the first and second slot machines.

10. The method of claim 9 further comprising the steps of:

calculating updated data for the total period of play on the first and second slot machines, the total amount played in the first and second slot machines and the total amount payed out by the first and second slot machines; and encoding updated data on the encodable card with the second card reader/encoder for the total period of play on the first and second slot machines, the total amount played, and the total amount of money paid out to the player by the first and second slot machines.

* * * * *